United States Patent [19]

Salminen

[11] Patent Number: 4,524,900

[45] Date of Patent: Jun. 25, 1985

[54] TWO-PIECE SLIDING BOX WITH TEAR STRIP SEPARATION

[75] Inventor: Arvo Salminen, Kauttua, Finland

[73] Assignee: A. Ahlstrom Osakeyhtio, Noormarkku, Finland

[21] Appl. No.: 524,034

[22] Filed: Aug. 17, 1983

[30] Foreign Application Priority Data

Aug. 30, 1982 [FI] Finland ..... 822992

[51] Int. Cl.[3] ..... B65D 5/38

[52] U.S. Cl. ..... 229/19; 206/605; 206/608; 206/611; 206/626; 220/416; 229/9

[58] Field of Search ..... 229/9, 10, 11, 19, 20; 206/605, 608, 611, 612, 626; 220/415, 416

[56] References Cited

U.S. PATENT DOCUMENTS

| | | | |
|---|---|---|---|
| 1,906,742 | 5/1933 | Coulapides | 229/19 X |
| 2,758,780 | 8/1956 | Imbs | 220/416 X |
| 3,128,935 | 4/1964 | Ricca | 229/19 |
| 3,161,346 | 12/1964 | Svensson | 206/607 |
| 3,648,918 | 3/1972 | Van Inwagen | 229/9 X |
| 3,987,955 | 10/1976 | Saarinen | 229/20 |
| 4,083,454 | 4/1978 | O'Neill | 206/605 |
| 4,189,087 | 2/1980 | Dlugopolski | 229/19 |

FOREIGN PATENT DOCUMENTS

| | | |
|---|---|---|
| 1934359 | 1/1971 | Fed. Rep. of Germany . |
| 49574 | 4/1975 | Finland . |
| 54252 | 10/1978 | Finland . |

*Primary Examiner*—William Price
*Assistant Examiner*—Gary E. Elkins
*Attorney, Agent, or Firm*—Bucknam and Archer

[57] ABSTRACT

A two-piece box consisting of a mantle-like outer part and, disposed inside the outer part, an inner part intended to be entirely or partly pulled out from the outer part and wherein the inner part and the outer part are attached to each other by means of a tear strip. The box is formed by folding the blank of the inner part and the blank of the outer part successively along the longitudinal fold lines of the box in the same direction. The tear strip is shorter than the longitudinal fold lines of the box. In the attachment flap of the outer part there is a slot in front of the tear strip so that the inner part and the outer part can be detached from each other without breaking the joint between the attachment flap and the side panel.

3 Claims, 3 Drawing Figures

TWO-PIECE SLIDING BOX WITH TEAR STRIP SEPARATION

FIELD OF INVENTION

This invention relates generally to a two-piece box consisting of a mantle-like outer part inside which there is an inner part intended to be pulled out entirely or partly from the outer part, and wherein the inner part and the outer part are detachably attached to each other.

BACKGROUND OF THE INVENTION

Finnish published patent application No. 49574 and German published patent application OS No. 1,934,359 disclose boxes privided with a tear strip or a tear flap. When erecting these boxes the blank of the inner part is first turned against the inner side of the blank of the outer part and then the box is formed by folding both blanks together along the longitudinal fold lines of the box. A disadvantage of the above mentioned boxes is the fact that the outer sides of the inner part and outer part of the box, i.e. the panels to be printed, are located on opposite sides of the blank. Therefore the blank has to be printed or surface-treated on both sides.

U.S. Pat. No. 4,083,454 discloses a two-piece box which has been formed by folding the blank of the box along the longitudinal fold lines of the box in the same direction. The inner part of the box is detached from the outer part by removing a tear strip connecting the parts. Due to the structure of the box, the mantle-like outer part is opened when the tear strip is removed.

Finnish published patent application No. 54252 discloses a two-piece box which has been formed by folding the blank of the inner part and the blank of the outer part successively in the same direction. The mantle-like inner part and the outer part of the box are detached from each other by subjecting force onto the weakened line connecting them. As the detachment requires special tools, it has to be carried out before the box is delivered to the user.

SUMMARY OF THE INVENTION

It is an object of the present invention to eliminate the disadvantages of the aforementioned boxes and to provide a box at low production costs.

A two-piece box in accordance with the invention is formed by folding the blanks of the inner and outer part sequentially in the same direction. The outer part and the inner part are attached to each other by means of a tear strip. The tear strip acts as a seal, but it can be easily removed.

The invention is characterized in that the tear strip is shorter than the longitudinal fold lines of the box and that in the outer part in front of the tear strip there is an opening, so that the inner part and the outer part can be detached from each other without opening the outer part.

BRIEF DESCRIPTION OF THE DRAWINGS

The invention will be described more fully with reference to the accompanying drawings. In the drawings.

DESCRIPTION OF PREFERRED EMBODIMENTS

Figure 1:
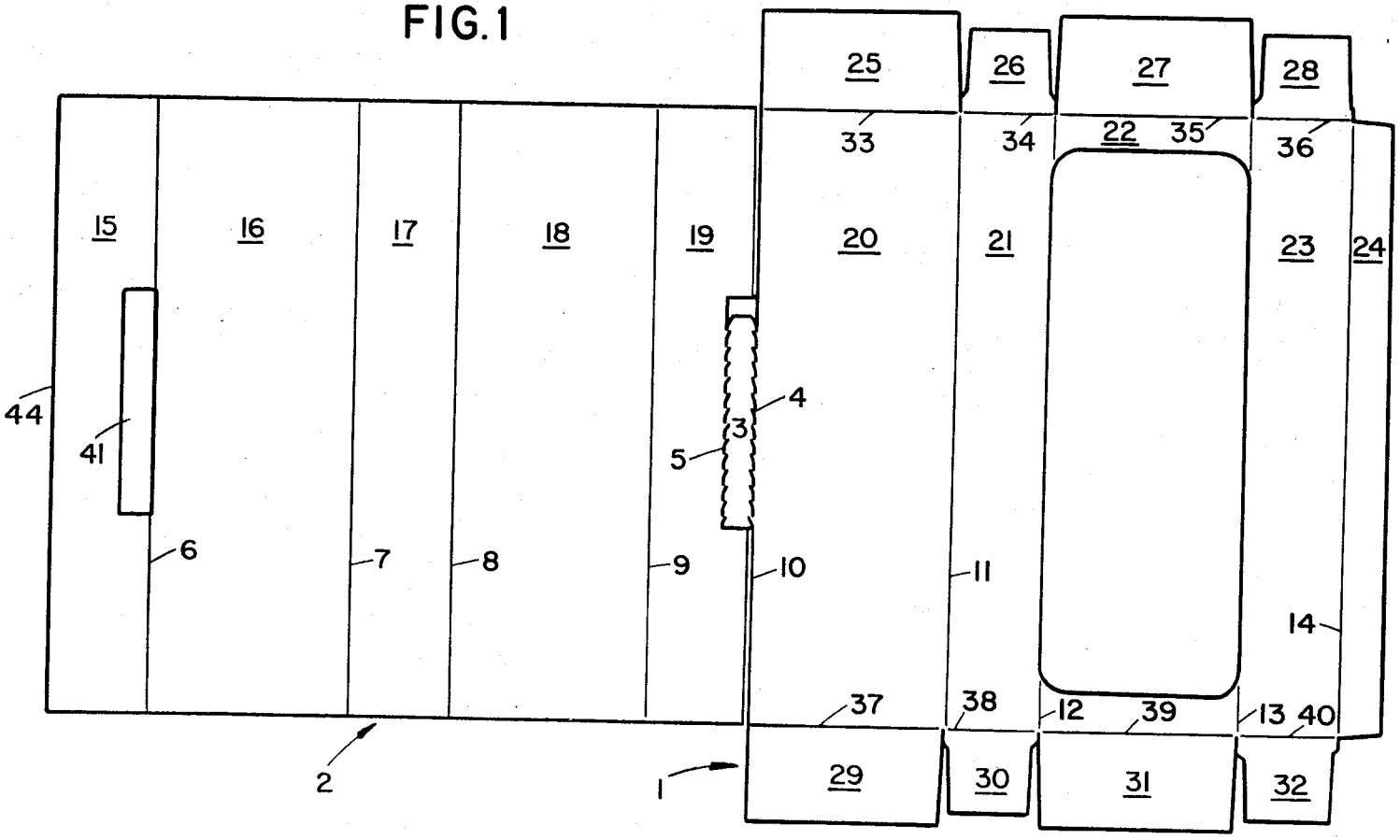
FIG. 1 shows an embodiment of a box blank in accordance with the invention.

In a blank of a box according to FIG. 1, a blank 1 of the inner part and a blank 2 of the outer part are attached to each other by means of a tear strip 3 which is connected to the blank of the inner part by means of a weakened joint 4 and the blank of the outer part by means of a weakened joint 5. The weakening has been accomplished in a suitable manner by perforation in the stanching phase. In the blank there are longitudinal fold lines 6–14 which separate the longitudinal panels of the box from each other. The outer part comprises an attachment flap 15, a bottom panel 16, side panels 17 and 19 and an upper side panel 18. The inner part comprises a bottom panel 20, side panels 21 and 23, an upper side panel 22, an attachment flap 24 and end flaps 25–32. The weakened line 4 is located between the bottom panel 20 of the inner part and the side panel 19 of the outer part and meets the cut line 10 between them. The bottom and side panels of the inner part are separated from the end flaps by means of transverse fold lines 33–40. In the attachment flap 15 there is a slot 41 which in an erected box is in front of the tear strip 3. The tear strip is shorter than the longitudinal fold lines of the box, e.g. appr. $\frac{1}{3}$ of the length of the fold line. The slot is so much longer than the tear strip that it is possible to grasp the other end of the tear strip.

Figure 2:
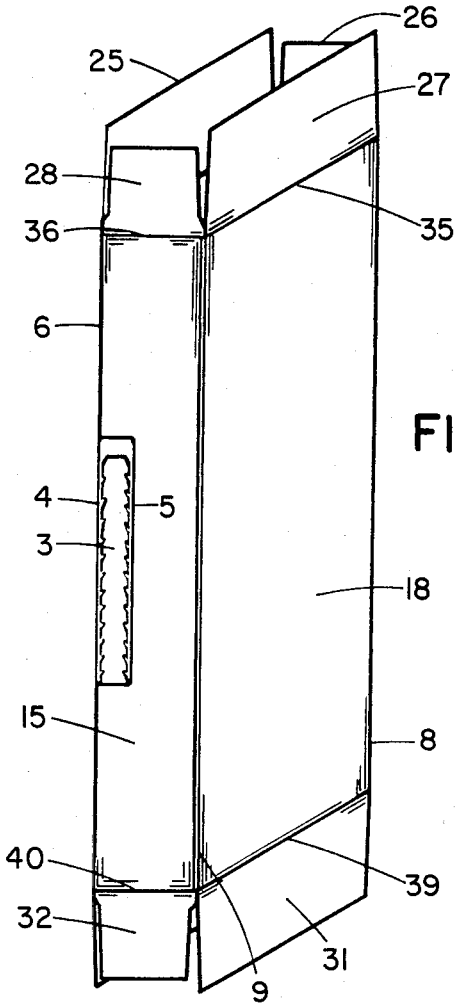
FIG. 2 shows a box formed from the blank according to FIG. 1 before the ends of the box are closed.

A box is formed from the blank so that first the blank is folded two-fold along the fold line 13, thereafter the two-fold part of the blank and the side panel 21 are folded along line 11 onto the side panel 19 and bottom panel 20 and the attachment flap 24 is glued to the bottom panel. Thereafter the blank is folded along fold lines 9 and 7 by rolling it all the time in the same direction and the attachment flap 15 is glued to the side panel 19. A pipe-like box according to FIG. 2 having a rectangular cross-section is assembled from the blank which has been glued in the manner described above by folding the blank also along the longitudinal fold lines 6, 8, 10 and 12. In the pipe-like box the blank of the box has been "rolled" so that one surface of the blank forms the outer surface of the inner and outer part and the other their inner surface.

Before the box is filled, one of the ends of the inner part is closed in a manner known per se by folding the end flaps 29–32 against the end along the londitudinal fold lines 37–40. The box is filled from the end which is left open, whereafter also that end is closed.

Figure 3:
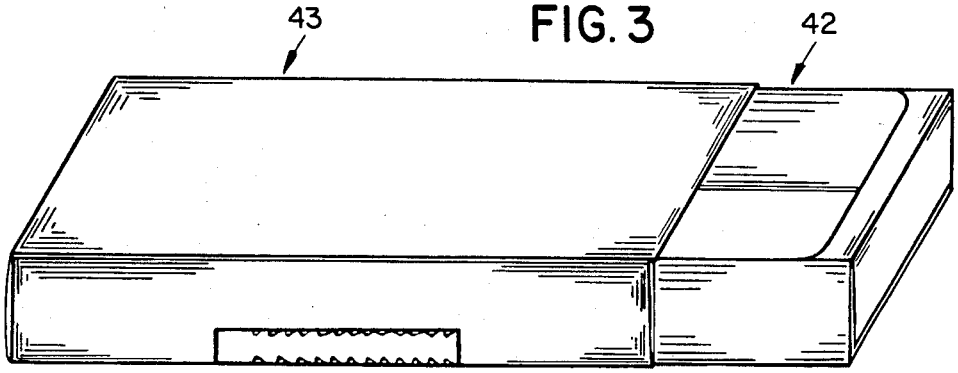
FIG. 3 shows a completed box after the tear strip has been removed and the box has been opened.

The box is opened by removing the tear strip 3, whereby the inner part 42 can be drawn out from the pipe-like outer part 43 longitudinally, as illustrated in FIG. 3.

The invention is naturally not limited to the embodiments presented above. Thus the location of the tear strip may vary. The slot in the side panel 15, may extend to the outermost edge 44, of the side panel or the side panel may be so narrow that it does not extend up to the tear strip. In that case, of course, no slot is required.

What is claimed is:

1. A container comprising an inner box and an outer box, said container being formed from a single blank having a first portion adapted to form the outer box and a second portion adapted to form the inner box, said inner and outer box being detachably attached to each other, the first blank portion comprising serially an attachment flap, a bottom panel, one side panel, an upper panel and another slde panel, the second blank portion comprising serially, a bottom panel, one side panel, an upper panel, another side panel and an attachment flap, each of said bottom panel, said side panels and attachment flap of the second blank portion having end flaps extending therefrom at opposite ends thereof, said panels of the first blank portion and said panels of the second blank portion being defined by longitudinal fold lines, said container having been assembled by folding the second blank portion and the first blank portion along said longitudinal fold lines sequentially in the same direction and fixing the attachment flap of the outer box to the last side panel of the outer box, a tear strip located between the bottom panel of the inner box and the last side panel of the outer box, said tear strip being shorter than the longitudinal fold lines, said tear strip having two edges, one edge coinciding with the longitudinal fold line between the bottom panel of the inner box and the last side panel of the outer box, a slot in the attachment flap of the first blank portion, an opening in the upper panel of the inner box, said slot overlapping the tear strip in the assembled container.

2. The container according to claim 1 wherein said slot extends to the outermost edge of the attachment flap of the outer box.

3. The container according to claim 1 wherein the slot is longer than the tear strip.

* * * * *